US008621885B1

(12) United States Patent
Niebolte

(10) Patent No.: US 8,621,885 B1
(45) Date of Patent: Jan. 7, 2014

(54) SINGLE BEVERAGE FREEZABLE CONTAINER

(76) Inventor: Eric P. Niebolte, Highlands Ranch, CO (US)

( * ) Notice: Subject to any disclaimer, the term of this patent is extended or adjusted under 35 U.S.C. 154(b) by 244 days.

(21) Appl. No.: 13/199,088

(22) Filed: Aug. 18, 2011

Related U.S. Application Data

(60) Provisional application No. 61/401,776, filed on Aug. 19, 2010.

(51) Int. Cl.
*F25D 3/08* (2006.01)

(52) U.S. Cl.
USPC ..... 62/457.4

(58) Field of Classification Search
USPC ..... 62/457.1, 457.3, 457.4, 457.5, 371, 530
See application file for complete search history.

(56) References Cited

U.S. PATENT DOCUMENTS 4,002,235 A * 1/1977 Donnelly ..... 206/219
4,163,374 A 8/1979 Moore et al.
4,870,837 A * 10/1989 Weins ..... 62/457.4
4,955,497 A 9/1990 Winden et al.
4,974,741 A 12/1990 Gustafson et al.
5,390,804 A 2/1995 Beggins
5,605,242 A * 2/1997 Hwang ..... 220/8
6,123,220 A 9/2000 Williams
6,398,061 B2 6/2002 Duff et al.
6,554,155 B1 * 4/2003 Beggins ..... 220/739
6,604,649 B1 8/2003 Campi
6,814,252 B2 * 11/2004 Murakami et al. ..... 220/739
7,201,285 B2 4/2007 Beggins
7,614,516 B2 11/2009 Beggins
8,365,941 B2 * 2/2013 Mayer ..... 220/259.3

* cited by examiner

*Primary Examiner* — Melvin Jones
(74) *Attorney, Agent, or Firm* — Ramon L. Pizarro; Edwin H. Crabtree

(57) ABSTRACT

A container for accepting and retaining bottles or cans for the purpose of insulating or bringing them to a desired temperature range is disclosed. A preferred embodiment includes a hollow upper section with an internal cylindrical portion that has an upper edge. The upper section includes an internal frusto-conical section with a slotted aperture that commences from the cylindrical portion and extends away from the cylindrical portion. The device also includes a hollow base section that is adapted for engaging the upper section. The arrangement accommodates cans as well as bottles, and allows drinking from either type of container while retaining the container.

10 Claims, 2 Drawing Sheets

SINGLE BEVERAGE FREEZABLE CONTAINER

REFERENCE TO RELATED APPLICATIONS

This application claims the benefit of my provisional application having Ser. No. 61/401,776, filed Aug. 19, 2010, now abandoned.

BACKGROUND OF THE INVENTION (a) Field of the Invention

This application relates to a system and device for retaining and cooling a beverage container, and more particularly, but without limitation, to a reusable container holder that is designed to be cooled and then used to cool a beverage container retained within the device.

(b) Discussion of Known Art

The need to cool or retain a beverage container, such as a beverage bottle or can, is well recognized. However, solutions for this problem have resulted in designs that provide significant compromises. For instance, devices that are used solely to insulate the beverage container do not provide the ability to also chill or heat the contents of the beverage container, if chilling or heating is desired. Devices that provide chilling capability, such as the device disclosed in U.S. Pat. No. 4,163,374 to Moore et al. lack the ability to accommodate both bottled and canned beverages, and thus provide limited versatility and utility. There is a need for a device or system that can be used to get canned or bottled beverages to a desired temperature range, and keep the beverage within the bottle or can at the desired temperature range.

Another example is disclosed in U.S. Pat. No. 6,604,549 to Campi discloses a device made of foamed plastic that can accommodate cans by using a "puck-shaped" lid, and can then be modified to accommodate long neck bottles by replacing the puck-shaped lid with a lid that follows the shape of the top of a long-neck bottle. Immediately apparent shortcomings of this approach is that the user must carry and store different types of lids for different types of containers, depending if one will be using the device with a can or a bottle.

An approach at alleviating the problems associated with the Moore et al. and the Campi type of devices is found in U.S. Pat. No. 6,814,252 to Murakami et al., which uses an extendible, flexible, frusto-conical section to accommodate the neck portion of a bottle. The frusto-conical section includes a pair of opposed stretch panels to accommodate various shapes of bottles.

Therefore, a review of known devices reveals that there remains a need for a container that can be used to keep bottled or canned beverages at a desired temperature range without having to modify the container to allow use of the device with a can or with a bottle, or whether it is used to hold a long-neck beer bottle or a feeding bottle for an infant.

SUMMARY

It has been discovered that the problems left unanswered by known art can be solved by providing a container for accepting and retaining bottles or cans for the purpose of insulating or bringing them to a desired temperature range, and which in a preferred embodiment includes:

A hollow upper section having an internal cylindrical portion that has an upper edge and a lower edge; the upper section also having an internal frusto-conical section that extends from the cylindrical portion, the frusto-conical section having a slotted aperture that commences from the cylindrical portion and extends away from the cylindrical portion, the cylindrical portion also having a threaded portion next to the lower edge; and A hollow base section, the base section having a base threaded portion that is adapted for engaging the threaded portion of the upper section.

According to a highly preferred embodiment of the invention the hollow upper section and the hollow base section are filled with a liquid or fluidized material such as a "freezer gel", which is commonly hydroxyethyl cellulose, or a polymer, or silica coated with vinyl, or other similar material with a high enthalpy of fusion. Thus the hollow upper section and the hollow base section will both be hollow shells or sections that are filled with freezer gel.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
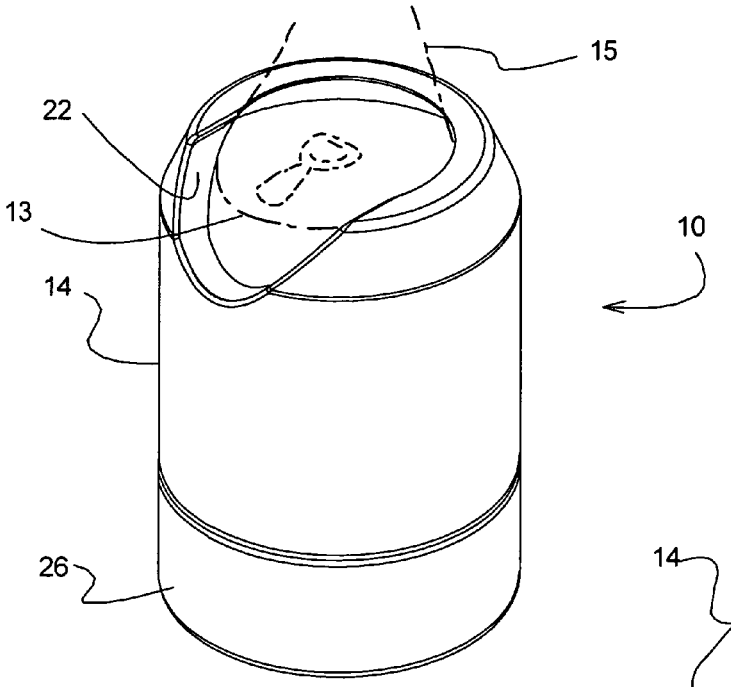
FIG. 1 is a perspective view of an embodiment of the disclosed invention while retaining a canned beverage, and also illustrates the outline of the positioning of a long-necked bottle when retained within the disclosed invention.

Attention is now directed to FIG. 1 where a preferred embodiment of the disclosed freezable container holder 10, which is designed for retaining a single beverage container 12, such as a bottle 13 or can 15, has been illustrated. The container holder 10 includes a hollow upper section 14 that has an internal cylindrical portion 16. The internal cylindrical portion 16 has an upper edge 18 and a lower edge 14. Additionally, the upper section 14 also includes an internal frusto-conical section 20, which while preferably being frusto-conical, may also be generally conical or shaped so as to accept the shape of a longneck type bottle.

Figure 3:
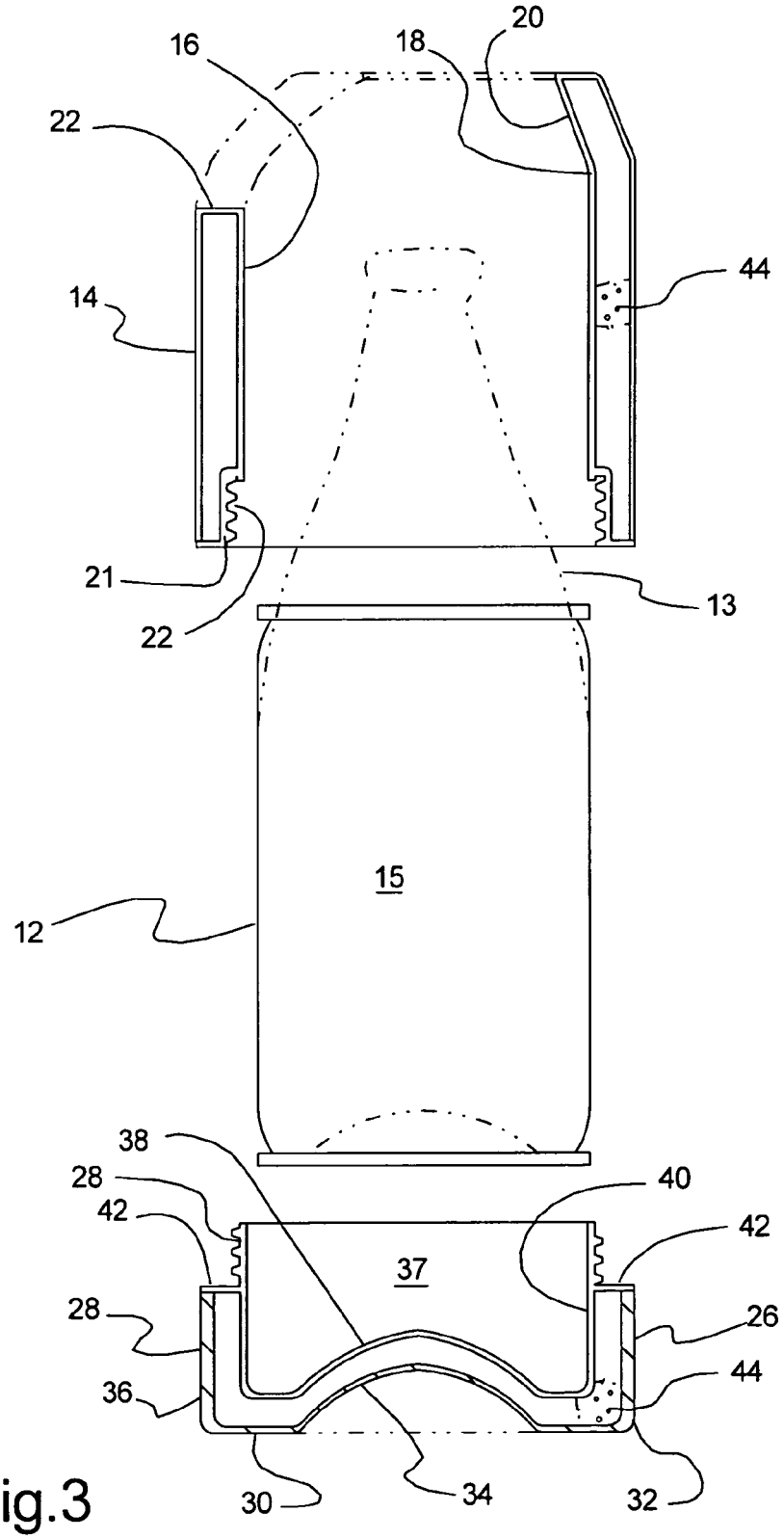
FIG. 3 is section view illustrating the fitment of the components illustrated in FIG. 2, and illustrating the nesting of the domed lower portion of the hollow base section and the domed recess commonly found in the bottom of bottles and cans.

As can be understood from FIGS. 1 and 3, the frusto-conical section 20 extends from the internal cylindrical portion 16, and preferably includes a slotted aperture 22 that extends through the frusto-conical section 20 and commences from a location that is at or next to the cylindrical portion and extends away from the cylindrical portion. FIG. 3 also makes it clear that, in a preferred embodiment of the invention, the cylindrical portion 16 includes a threaded portion 24 next to the lower edge 21. It is important to note that while threads have been illustrated as being the preferred embodiment, it is also contemplated that slotted engagement mechanisms may also be used.

The threaded portion 24 of the hollow upper section 14 cooperates with a hollow base section 26 to capture or enclose the beverage container 12 between the two sections. The hollow base section 26 includes a base threaded portion 28 that is adapted for engaging the threaded portion 24 of the hollow upper section 14. The use of threads adds adjustability to the disclosed system in that turning the upper section 14 relative to the hollow base section 26 allows adjustment of the overall length of the disclosed invention in order to accommodate variations in length or shapes of cans of bottles that are to be retained by the disclosed invention.

Figure 2:
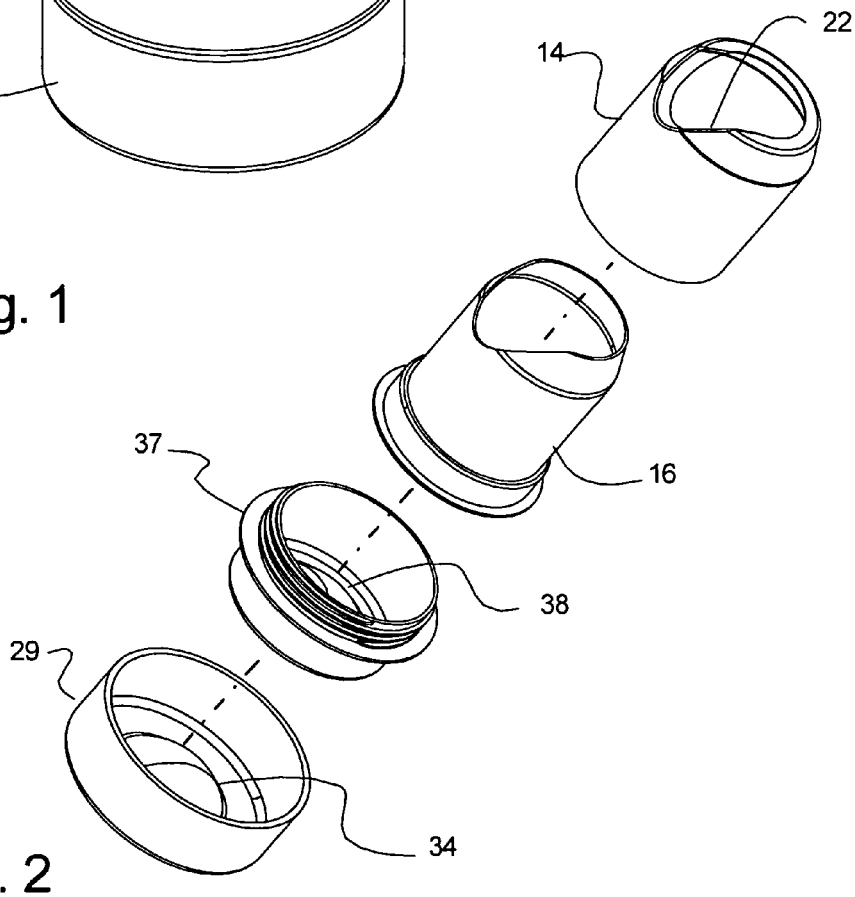
FIG. 2 is an exploded view of the components used to make the he hollow upper section and the hollow base section. The internal freezer gel material has been omitted from the view.

Referring to FIGS. 2 and 3, it will be understood that the hollow base section 26 is preferably made up from a base shell section 29 that has a horizontal base portion 30 that includes a perimeter 32, which may be a flat-ring shape or curved section, and a base domed section 34. The base shell section 28 of the hollow base section 26 also includes a wall portion 36 that extends up from the perimeter 32 and around the base domed section 34.

FIGS. 2 and 3 also show that the hollow base section 26 also preferably includes a base inner sleeve 37. The illustrated preferred example of the base inner sleeve 37 includes a generally domed bottom section 38 that is at a distance or spaced apart from the base domed section 34. Additionally, the base inner sleeve 37 includes a base inner wall 40 that extends up from the generally domed bottom section 38 and ends in the base threaded portion 28. A base sealing wall 42 that extends from the base inner wall 40 to the wall portion 36 of the base shell section 29 when the base inner sleeve 37 is inserted into the base shell section 29. As illustrated in FIG. 3, the generally domed bottom section 38 is adapted for engaging the recess 44 commonly found on the bottom of the bottle or can, which is the single beverage container. Thus, as shown in FIG. 3, the base domed section 34 adapted for extending into the generally domed bottom section 38 when the base sealing wall 42 is in contact with the wall portion 36 of the base shell section 29.

Thus, it will be understood that the hollow upper section 14 and the hollow base section 26 may be filled with a liquid 44 or fluidized material such as a "freezer gel", which is commonly hydroxyethyl cellulose, or a polymer, or silica coated with vinyl, or other similar material that may be frozen so that the disclosed invention may be used to cool the bottle 13 or can 15 retained by the invention.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A single beverage container holder comprising:

A hollow upper section having an internal cylindrical portion that has an upper edge and a lower edge, the upper section further comprising an internal frusto-conical section that extends from the cylindrical portion, the frusto-conical section having a slotted aperture that extends through the frusto-conical section and commences from a location next to the cylindrical portion and extends away from the cylindrical portion, the cylindrical portion also having a threaded portion next to the lower edge; and A hollow base section, the base section having a base threaded portion that is adapted for engaging the threaded portion of the upper section.

2. A single beverage container holder according to claim 1 wherein said hollow base section comprises a base shell section having a horizontal base portion having a perimeter, and a wall portion that extends up from the perimeter; and a base inner sleeve, the base inner sleeve having a generally domed bottom section and a base inner wall that extends up from the generally domed bottom section and terminating in the base threaded portion, and a base sealing wall that extends from the base inner wall to the wall portion of the base shell section, the generally domed bottom section being adapted for engaging the single beverage.

3. A single beverage container holder according to claim 2 wherein said horizontal base portion of the base shell section includes a shell domed section that is adapted for extending into the generally domed bottom section when the base sealing wall is in contact with the wall portion of the base shell section.

4. A single beverage container holder according to claim 3 wherein said hollow upper section and said hollow base section are filled with a fluid.

5. A single beverage container holder according to claim 4 wherein the hollow base section and the hollow upper section are filled with a liquid.

6. A container holder for retaining a single beverage container having a domed base, the container holder comprising:

A hollow upper section having an internal cylindrical portion that has an upper edge and a lower edge, the upper section further comprising an internal frusto-conical section that extends from the cylindrical portion, the frusto-conical section having a slotted aperture that extends through the frusto-conical section and commences from a location next to the cylindrical portion and extends away from the cylindrical portion, the cylindrical portion also having a threaded portion next to the lower edge; and A hollow base section, the base section having a base threaded portion that is adapted for engaging the threaded portion of the upper section.

7. A single beverage container holder according to claim 6 wherein said hollow base section comprises a base shell section having a horizontal base portion having having a perimeter and a base domed section, and a wall portion that extends up from the perimeter and around the base domed section; and a base inner sleeve, the base inner sleeve having a generally domed bottom section that is at a distance from the base domed section, and a base inner wall that extends up from the generally domed bottom section and terminating in the base threaded portion, and a base sealing wall that extends from the base inner wall to the wall portion of the base shell section, the generally domed bottom section being adapted for engaging the single beverage.

8. A single beverage container holder according to claim 7 wherein said horizontal base portion of the base shell section includes a shell domed section that is adapted for extending into the generally domed bottom section when the base sealing wall is in contact with the wall portion of the base shell section.

9. A single beverage container holder comprising:

a hollow upper section having an internal cylindrical portion that has an upper edge and a lower edge, the upper section further comprising an internal frusto-conical section that extends from the cylindrical portion, the frusto-conical section having a slotted aperture that extends through the frusto-conical section and commences from a location next to the cylindrical portion and extends away from the cylindrical portion, the cylindrical portion also having a threaded portion next to the lower edge; and a hollow base section, the base section having a base domed section and a base threaded portion that is adapted for engaging the threaded portion of the upper section.

10. A single beverage container holder according to claim 9 wherein the hollow base section and the hollow upper section are filled with a liquid.

* * * * *